US006079570A

United States Patent [19]

Oppliger et al.

[11] Patent Number: 6,079,570

[45] Date of Patent: Jun. 27, 2000

[54] METHOD AND DEVICE FOR CONTROLLING AN ARRANGEMENT TO DISTRIBUTE ARTICLES TO BE SORTED TO PHYSICAL TARGET LOCATIONS

[75] Inventors: Jean-Claude Oppliger, Niederhasli; Samuel Kaspar, Gränichen, both of Switzerland

[73] Assignee: Grapha-Holding AG, Hergiswil, Switzerland

[21] Appl. No.: 08/925,755

[22] Filed: Sep. 9, 1997

[30] Foreign Application Priority Data

Sep. 9, 1996 [CH] Switzerland ..... 2208/96

[51] Int. Cl.[7] ..... B07C 5/00

[52] U.S. Cl. ..... 209/630; 209/705; 209/706; 209/900

[58] Field of Search ..... 209/629, 630, 209/702, 705, 706, 900, 909; 198/370.01, 370.03

[56] References Cited

U.S. PATENT DOCUMENTS

| | | | |
|---|---|---|---|
| 4,106,636 | 8/1978 | Ouimet et al. | 198/350 |
| 4,963,251 | 10/1990 | Bohm et al. | 209/900 X |
| 5,086,929 | 2/1992 | Richter et al. | 209/900 X |
| 5,147,048 | 9/1992 | Signoretto | 198/369 X |

FOREIGN PATENT DOCUMENTS

| | | | |
|---|---|---|---|
| 428416 | 5/1991 | European Pat. Off. | 209/900 X |
| 0 586 883 A2 | 8/1993 | European Pat. Off. . | |
| 43 02 231 A1 | 1/1993 | Germany . | |

*Primary Examiner*—Tuan N. Nguyen

*Attorney, Agent, or Firm*—Venable; Robert Kinberg

[57] ABSTRACT

An arrangement is provided for distributing articles to be sorted to physical target locations. The articles to be sorted are delivered to a number of receiving elements that move along a conveying path past the physical target locations. The receiving elements are controlled so that the physical target locations are assigned dynamically and in dependence on the operating sequence for the sorting operations to the logical sorting targets, which optimizes the capacity of the arrangement and the operating sequence.

14 Claims, 2 Drawing Sheets

METHOD AND DEVICE FOR CONTROLLING AN ARRANGEMENT TO DISTRIBUTE ARTICLES TO BE SORTED TO PHYSICAL TARGET LOCATIONS

CROSS-REFERENCE TO RELATED APPLICATIONS

Priority is claimed with respect to Swiss application No. CH 1996 2208/96 filed in Switzerland on Sep. 9, 1996, the disclosure of which is incorporated herein by reference.

BACKGROUND OF THE INVENTION

The invention concerns a method for controlling an arrangement to distribute articles to be sorted to physical target locations and a suitable control device for carrying out this method. In a known arrangement, there are provided a number of receiving elements each for respectively receiving one article to be transported along a conveying path past the physical target locations. At least one feeder is used to deliver the articles to be sorted to the receiving elements. An information set corresponding to one address is provided on each article to be sorted. The information set is detected and each receiving element is selectively controlled to release the articles to one of the physical target locations in dependence on the detected information set while the receiving element is transported past the physical locations. The invention also concerns.

Arrangements to distribute articles to be sorted to physical target locations are used, for example, in post offices for sorting of letters according to delivery regions or receiving locations. The control of these arrangements traditionally depends on permanently assigning one of the physical target locations to each of the delivery regions or receiving locations according to which the articles are sorted. Consequently, the letters representing the articles to be sorted accumulate during the sorting operation at the physical target locations assigned to the delivery regions or receiving locations. As a result of this, all the letters sorted according to delivery regions or receiving locations are sorted and present at these physical target locations, from which they can be removed for further processing.

However, in most cases of use, the flow-rate, meaning the number of articles to be sorted per unit of time, which must be delivered, differs from target location to target location. These flow-rates also change in dependence on the articles to be sorted which must be processed. For example, when sorting letters for a specific delivery region or a specific receiving location, the number of letters accumulating over the time period of a year can fluctuate strongly in an unpredictable way. As a result of the permanent assignment of the physical target locations, the particularly high flow rates occur at differing target locations, meaning it is possible that the physical target location in the least favorable spot for a rapid processing must accommodate the highest flow rate. As a result of this permanent assignment, it can also happen that target locations with only a low flow rate or no flow rate at all are tied up, while other target locations are rapidly filled owing to a very high flow rate and consequently waiting periods must be taken into account for a frequent emptying of the filled target locations.

SUMMARY OF THE INVENTION

It is an object of the invention to create a method of the aforementioned type, for which the assignment of the physical target locations is adapted to the changing realities of the sorting processes, as well as a suitable control device for carrying out the method.

With respect to the control method, the above and other objects are accomplished in that a logical target location is assigned to each article to be sorted, which location is predetermined in dependence on the detected information set, and that the physical target location to which the article to be sorted that is assigned to this logical target location is delivered is then determined in dependence on determined flow-rate values for the articles assigned to the logical target locations.

Thus, with the solution according to the invention, only one logical target location is initially assigned to the article to be sorted, owing to the detection of the information set that represents the address of the reference location of an article to be sorted, which must be delivered to an empty receiving element. The interdependence between the information sets and the logical target location that determines this assignment is predetermined, for example in the form of a sorting table. When sorting according to delivery regions, such a sorting table contains, for example, a data set representing the associated delivery region as the logical target location for each information set representing an address. If the information set of an article to be sorted cannot be detected owing to poor legibility or if the sorting table does not contain the detected information set, a specific logical target location is can be manually assigned.

In this way, exactly one logical target location is finally assigned to each of the articles to be sorted that are delivered to the receiving elements. The flow-rates of articles to be sorted for the various logical target locations are determined in order to determine the physical target locations to which the articles are to be delivered by the receiving elements while they are transported past the physical target locations. In the most simple case, the flow rate may be the number of articles to be sorted, which are respectively assigned to the logical target positions for each time unit. Varied determinations can also be made for articles to be sorted that have different sizes, e.g. where at least one dimension is considered in the flow rate value. The physical target locations are then fixed in dependence on the flow rate values determined for the various logical target locations and the articles to be sorted are selectively delivered to the physical target locations in dependence on the flow rates while the receiving elements are transported past.

It is possible, for example, to determine a physical target location in an especially favorable position in space for the logical target location with the highest flow rate value, which permits a rapid removal for further processing of the delivered article to be sorted. This determination of the physical target locations is changed during an operational sequence in accordance with the changes in the flow rate values that occur during this sequence. It is understood that during this change only those physical target locations can be determined anew, which do not contain articles to be sorted that were delivered prior to the change, meaning only empty physical target locations. This requirement can be met easily by monitoring the filling level of the target locations.

At the beginning of a sorting operation, the determination of the physical target locations requires a start-up time, during which the receiving elements can only be filled, but not emptied. Thus, the start-up time is limited by the receiving capacity of the arrangement, meaning the number of available receiving elements. Instead of performing the initial determination of the physical target locations during the start-up time, it is also possible to begin with a preset determination of the physical target locations, which can, for example, be selected according to empirical aspects, thus permitting an immediate emptying of the receiving elements. This preset determination is then changed in accordance with the flow-rate values determined during the continued operational sequence.

An advantageous embodiment of the method according to the invention provides that the sum of the thicknesses of the articles to be sorted, which are assigned to a given logical target location during a unit of time, are measured along a preset direction in space, and is used to determine the flow rate value for the articles assigned the logical target location. This method of determining the flow rate is primarily suited for the sorting of letters, which are deposited at the physical target locations with their main surfaces touching, wherein the main surface, for example, extends in a horizontal direction. The sum of these thicknesses accumulating during a unit of time corresponds to the stack height forming at the physical target location during each unit of time and thus supplies a measure of how fast this physical target location must be emptied.

Further embodiments of the method contribute to the simplicity of the measuring or detecting operation in that the thickness is respectively measured prior to the delivery of the article to be sorted to the receiving element and/or the information set provided on the article to be sorted is detected respectively prior to its delivery to the receiving element.

A considerable advantage results from an embodiment of the method, which provides that more than one physical target location is determined for a logical target location with a high flow rate as compared to other logical target locations. Owing to the high flow rate, the physical target location first reached along the conveying path by the receiving elements filled with the articles to be sorted that are assigned to the logical target location is filled relatively rapidly and is then blocked once the maximum filling level has been reached. Since at least one additional physical target location is determined for this logical target location with high flow rate along the conveying path, the respective articles to be sorted can still be delivered without interruption to this additional physical target location. The physical target location previously filled to the maximum level can in the meantime be cleared and unblocked again, so that it will be available once more to accept articles to be sorted. This operation, which is explained with the aid of an exemplary embodiment for two physical target locations, can also be carried out for a higher number of physical target locations while cyclically rotating.

In accordance with another aspect of the invention, the method can also be carried out such that the articles to be sorted, which are assigned to a logical target location with low flow rate as compared to another logical target location, are kept inside the receiving elements for the duration of a dwell time and no physical target location is determined for this logical target location during the dwell time. The low flow rate means that for each time unit only a few of the articles to be sorted, which are assigned to this logical target location, are deposited in the receiving elements that are transported along the conveying path. Since these articles to be sorted therefore occupy only a few receiving elements, they can remain for a period without interfering with the transfer and delivery operation of the remaining receiving elements, so that it is not necessary to determine a physical target location for the respective logical target location during the dwell time. As a result of this, more physical target locations are available for a logical target location with a higher flow rate.

It is also provided within the framework of the invention that the assignment of the logical target locations that is determined by the preset dependence is preset again during the operational sequence and that physical target locations are determined for the logical target locations assigned to the articles to be sorted under the newly preset dependence owing to the detected information set. These physical target locations are selected from the number of physical target locations determined under the previously preset dependence.

Conducting the method in this way avoids reductions in the capacity that can occur, for example, during the change from one type of sorting operation to another type, e.g. from the sorting according to receiver locations to the sorting according to delivery regions. In the first-mentioned type of sorting operation, a sorting table representing the preset dependence contains the assignment between the possible information sets for the articles to be sorted and the receiver locations that represent the logical target locations, whereas in the second type of operation mentioned, the sorting table contains the assignment between the possible information sets and the delivery regions as logical target locations. Without the steps provided in accordance with the invention, it is necessary when changing from one type of sorting operation to another to deliver first all articles to be sorted that must be sorted according to the first type of sorting table from the receiving elements to the physical target locations. Only after all receiving elements and subsequently all target locations are empty is it possible to start delivering articles that must be sorted according to the second type of operation to the receiving element. This emptying operation proves to reduce the capacity because additional articles for sorting cannot be accepted under this method despite the reduction in flow rate that decreases continuously during the course of the emptying operation.

Since the method according to the invention detects the reduction in the flow rates, it is possible to gradually remove physical target locations intended for the first type of sorting operation in accordance with this reduction and to make these available to the second type of sorting operation, which starts up with an increasing flow rate. As a result of this, a continuous change between the first type of sorting operation and the second type is possible without noticeable loss in capacity. It is understood that the physical target locations removed from the first type of sorting operation and assigned to the second type of sorting operation must be empty before being reassigned, which can be ensured without problems through a monitoring of the filling level of the physical target locations.

The objects of the invention are further accomplished by the provision of a control device for an arrangement designed to distribute articles to be sorted to physical target locations, comprising: a plurality of receiving elements; a feeder for feeding articles to be sorted to respective ones of the plurality of receiving elements, each article containing an information set having a reference content corresponding to one address; a plurality of physical target locations; means for conveying the receiving elements along a conveying path past the physical target locations, the receiving elements each including a first device that can be activated to release the article to be sorted from the receiving element to a selected physical target location while the receiving element is transported past the physical location; a second device for detecting the information sets on the articles to be sorted; and a control device for activating the first device in dependence on the detected information sets for a selective release of the articles to be sorted to the physical target locations, the control device comprising: a third device for assigning logical target locations to the articles to be sorted in accordance with a predetermined dependence on the detected information sets; a fourth device for determining flow rate values for the articles to be sorted which are assigned to the logical target locations; and a firth device for determining the physical target locations to which the articles to be sorted are delivered in dependence on the determined flow-rate values.

Among the various embodiment described below, a particularly usefulness embodiment is described wherein the control device includes a unit for reprogramming the first memory region of the device used to assign the logical target locations. The interdependence between the possible information sets and the logical target locations and in particular the type of sorting table can thus be changed easily.

Finally, as a result of the dynamic determination or assignment of the physical target locations in accordance with the invention, it makes sense to design the arrangement so that each physical target location is assigned a visual display that is actuated by the control device and displays information showing the respectively associated logical target location. In this way, the user is shown at any time which articles to be sorted are accumulating at that moment at each physical target location.

Other characteristics, details and advantages of the invention result from the following description, in which an exemplary embodiment is explained in more detail by referring to the drawing.

DETAILED DESCRIPTION OF THE INVENTION

Referring to the figures, there is shown an arrangement 10 for distributing articles to be sorted in the form of letters. The arrangement includes pocket-type receiving elements 12 as shown generally in FIG. 1 and in more detail in FIGS. 2 and 3. Receiving elements 12 are suspended equidistant and one after another from a conveying element 16 that circulates endlessly along a conveying path 14, thereby causing receiving elements 12 to be transported along conveying path 14.

Figure 1A:
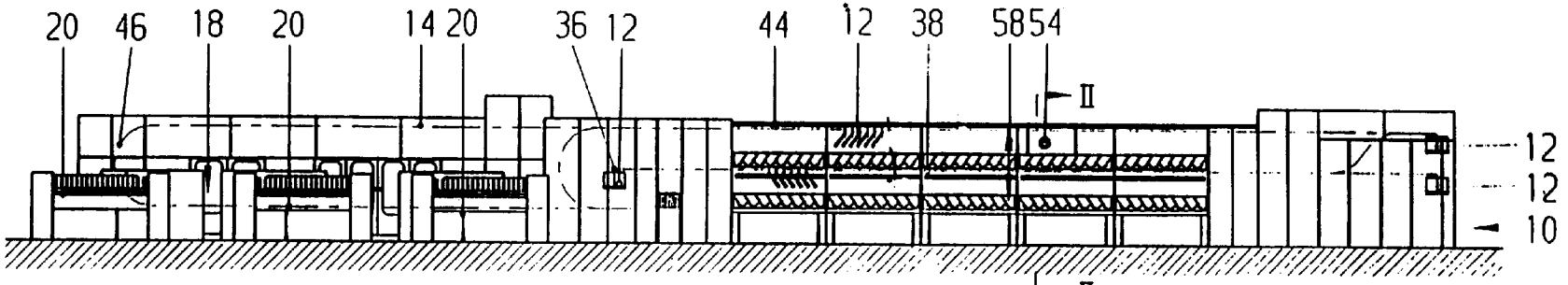
FIGS. 1(*a*) and 1(*b*) show respectively side and plan diagrammatic views of an arrangement for distributing articles to be sorted according to the invention.
Figure 1:
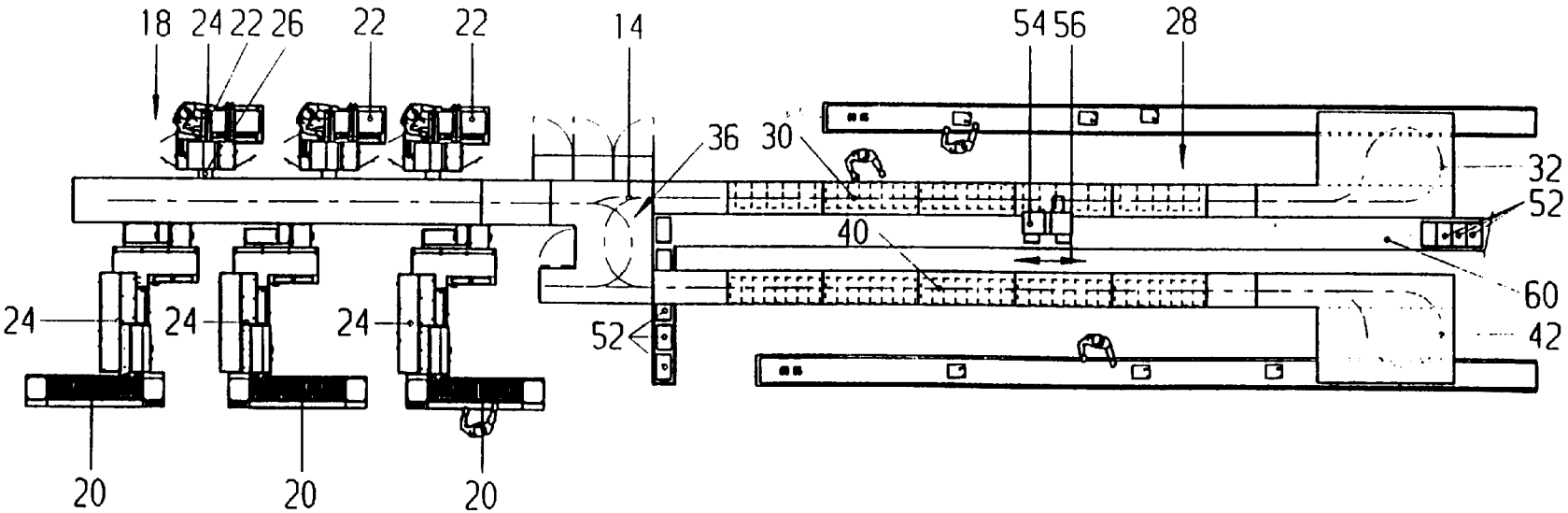

As shown on the left in FIG. 1, supply stations 20, 22 with feeders 24 that operate in the direction of conveying path 14 are arranged along a section 18 of conveying path 14. Each of these feeders delivers respectively one article 26 to be sorted, namely a letter, to a receiving element 12 that is transported past the respective feeder 24. During the continued course of transport, receiving elements 12 are raised from section 18 to an upper section 28 of conveying path 14, which can be seen in FIG. 2. There they are transported past a number of physical target locations 30, arranged along the upper section 28, to which the articles to be sorted are delivered by receiving elements 12. Subsequently, conveying path 14 for receiving elements 12 travels through a reversing section 32 and into a lower section 34, which also has a number of physical target locations 30 arranged along it. The conveying path 14 then passes through a reversing section 36, which is joined by a lower section 38, along which a number of physical target locations 40 are arranged as well. The conveying path 14 then continues as a reversing section 42 and rises to become an upper section 44, along which a number of physical target locations 40 are arranged as well. Lower section 38 and upper section 44 can be seen in the side view of FIG. 2. Subsequently, conveying path 14 returns along a section 46 (left hand side of FIG. 1(*a*) that forms a vertical curve to the section 18 with supply stations 20, 22. As can be appreciated from FIG. 2, upper sections 28 and 44 extend in a horizontal plane, while lower sections 34 and 38 extend underneath section 28 and 44 also in a horizontal plane.

The design of conveying path 14 shown in FIGS. 1(*a*) and 1(*b*) is only an example. Any shape for conveying path 14 is suitable, which permits transporting receiving elements 12 past feeders 24 and physical target locations 30, 40.

Figure 2:
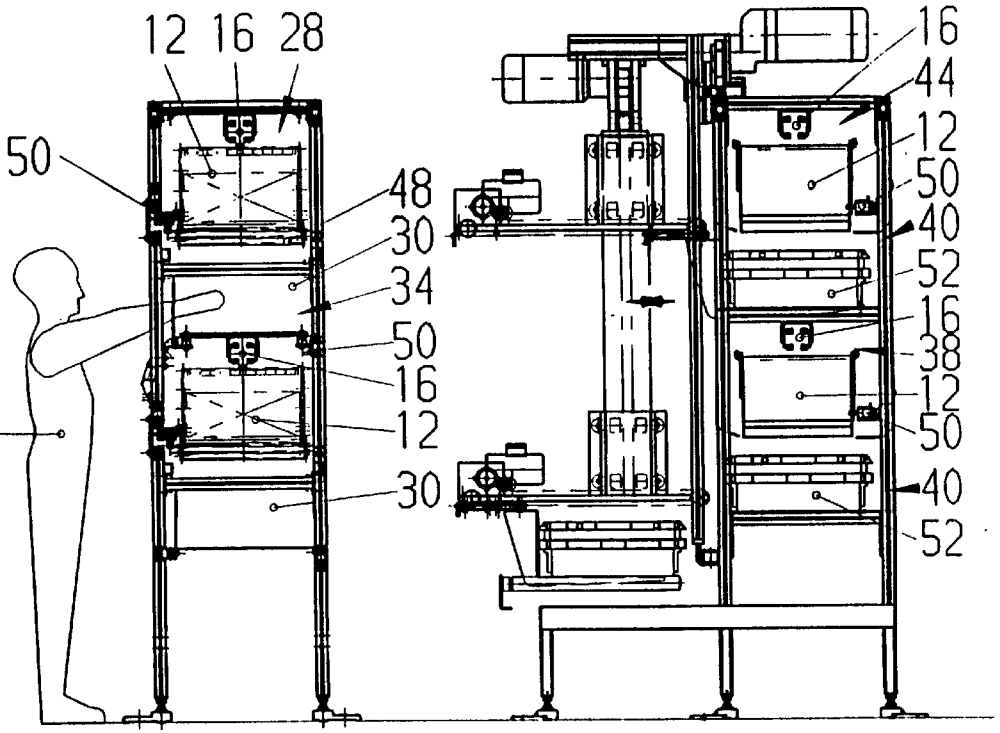
FIG. 2 is a cross section through the arrangement according to line II—II in FIG. 1(*a*).
Figure 3:
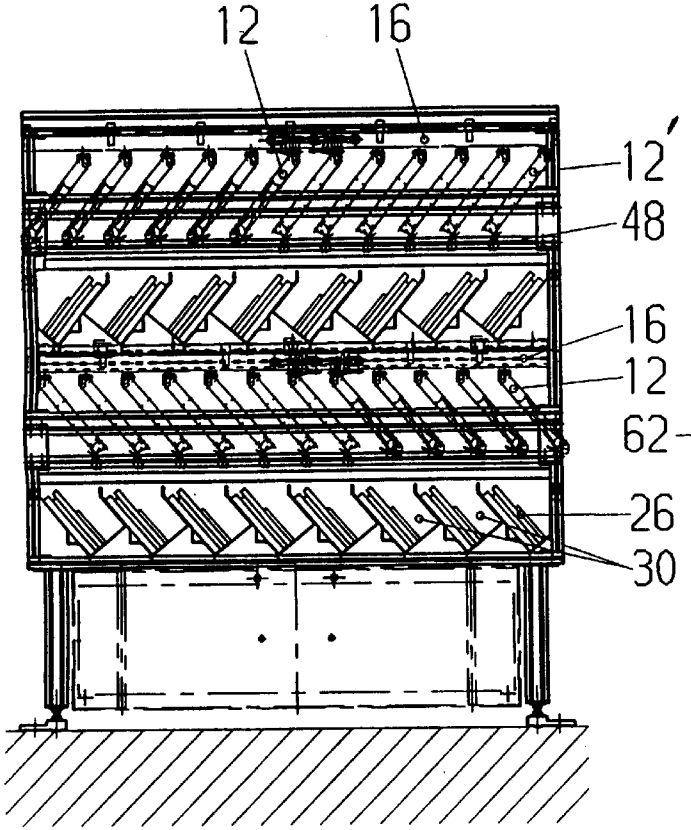
FIG. 3 is a detailed partial view of the arrangement in FIG. 1(*a*).

FIGS. 2 and 3 show that pocket-shaped receiving elements 12, which are suspended at one of their ends from conveying element 16, have a flap 48 on the opposite end, which is tensioned with spring force to assume a position where the respective receiving element 12 is closed, wherein this flap 48 can also be pivoted to an open position, as shown for the receiving element 12' in FIG. 3. For this purpose, flap 48 has a lever on the side, which is not shown in detail here and which moves past a locally fixed delivery device 50, shown on the right in FIG. 2, while receiving element 12 is transported along conveying path 14. Once activated, this delivery device extends an opening cam, into which the activation lever bumps, thereby causing flap 48 to open. In contrast, receiving element 12 moves past the delivery device if the opening cam is not extended and flap 48 is not opened.

Such a delivery device 50 is assigned to each of the physical target locations 30, 40. As a result of the above-described activation of delivery device 50, it is possible to selectively open flaps 48 of receiving elements 12 while they are transported past physical target locations 30, 40 and thus deliver the articles to be sorted, which are transported in receiving elements 12, via the force of gravity to the respective physical target locations.

It also follows from FIG. 2 that in the region containing lower section 38 and upper section 44 of arrangement 10, physical target locations 40 are provided with respectively one collection bin 52 into which the articles to be sorted are deposited by receiving elements 12. A manipulation robot 54 is used to remove filled collection bins 52 and to supply empty collection bins 52. This robot can be moved along segments 38, 44, as shown with a double arrow 56 in FIG. 1(*b*), but can also be moved vertically, as shown with a double arrow 58 in FIG. 1(*a*). As a result of this, it has access to all physical target locations 40 arranged along sections 38, 44. Manipulation robot 54 is furthermore supported by a band conveyor 60, shown diagrammatically in FIG. 1(*b*), for a further transport of collection bins 52 to and from the region where arrangement 10 is located.

The physical target locations in the region of arrangement 10, comprising upper section 28 and lower section 34, are embodied as stationary compartments according to the representation in FIG. 3, into which the articles to be sorted are deposited by receiving elements 12. As shown in FIG. 2, physical target locations 30 are then emptied manually by an operator 62.

Arrangement 10 is controlled by a micro-computerized control device that is not shown in the drawing, resulting in the operational sequence described below.

Each article 26 for sorting is provided with an information set. For the described embodiment, this is the receiving address listing the street, a zip code number, and locality information affixed to the letter that comprises the article to be sorted. The information sets are detected at supply stations 20 that supply the articles to be sorted in that they are read automatically with a scanner attached to the control device. At supply stations 22, on the other hand, the information sets are detected manually by operators and the data corresponding to the information sets is then entered into the control device.

Once the information set of an article 26 to be sorted is detected in this way, it is delivered by the respective feeder 24 to receiving element 12, which is at that moment transported past feeder 24. In order to identify the receiving element 12 that accepts the article 26 to be sorted, the control device receives a signal indicating the relative position between a tag that is transported along the conveying path 14, together with receiving element 12 and a stationary sensor that detects the passing of this tag.

As a result of this identification of receiving elements 12 and the detected data sets for the articles 26 to be sorted contained therein, the control device maintains a logical image of all receiving elements 12 and the information sets of the articles 26 to be sorted contained therein. A sorting table is furthermore stored in a first memory region, which reflects an assignment between all possibly occurring information sets and logical target locations. The latter correspond to delivery regions, e.g. if the articles must be sorted according to these, or to receiving locations, if the articles must be sorted according to these. In addition, at least one logical target location is provided, which is assigned to all articles to be sorted on which the information sets cannot be read or which have not been provided with an information set at all.

Using the logical image of receiving elements 12 that is stored in a second memory region and owing to the interdependence between the information sets and the logical target stations, which is expressed in the first memory region, the control device assigns to each identifiable receiving element 12 the logical target location corresponding to the information set of the article 26 to be sorted, which is contained therein. The first and second memory regions therefore represent a component part of a device for assigning the logical target locations, which is provided in the control device.

The delivery of articles 26 to be sorted to receiving elements 12, which precedes this process of assigning the logical target stations, can be carried out particularly easily with the exemplary embodiment shown in FIG. 1 in that receiving elements 12, which are suspended downward from conveying element 16 in upper section 44, point upward and away from conveying element 16 in section 18, containing supply stations 20, 22, as a result of passing through section 46 that forms the vertical curve, so that the opening closed off by flap 48 points upward. Flaps 48 consequently must only be opened in a similar manner in the region of feeder 24, which takes place by means of delivery device 50. The articles 26 to be sorted consequently can be inserted by feeders 24 from the top into receiving elements 12.

A measuring instrument is provided in the region of each supply station 20, 22, which measures the thicknesses perpendicular to the main plane of articles 26 to be sorted, meaning the letters, during the delivery by feeders 24 and enters these measurements into a device provided in the control device. For each target location, this device sums up the thicknesses of the articles to be sorted measured over a specific unit of time, which articles are assigned to this logical target location on the basis of the detected information sets. The sum of these values therefore represents the flow rate with respect to volume of the articles 26 to be sorted, which are assigned to the respective logical target location.

An additional component part of the control device determines for each logical target location the physical target location 30, 40 to which articles 26 to be sorted that are assigned to the respective logical target location are delivered by receiving elements 12. As soon as the physical target location is determined, the component part of the control device emits a signal for activating the opening cams of delivery device 50, which is arranged at the respective physical target location 30, 40, if a receiving element 12 is transported past it and contains an article 26 to be sorted that is assigned to the respective logical target location. The determination of the physical target locations 30, 40 in this case occurs in dependence on the flow-rate values determined for the logical target locations. For example, the physical target location 40 with the shortest access time for manipulation robot 54 is respectively assigned to the logical target location with the maximum flow-rate value, while the remaining physical target locations 40 are assigned in a continued order of the access times. Also, several physical target locations 30, 40 can be assigned to a logical target location with a particularly high flow rate, wherein completely filled target locations are respectively blocked through blocking of delivery device 50 and, instead, delivery devices 50 for the remaining, assigned physical target locations 30, 40 are activated, for example in a cyclical sequence, wherein the respectively filled physical target locations 30, 40 are emptied during this cycle by operator 62 or manipulation robot 54 so that they are available again for the delivery operation.

In particular, the device for determining the physical target locations 30, 40 has a third memory region for respectively storing the assignment between the logical target locations and the physical target locations 30, 40 that changes dynamically over the course of time. An identifier can also be planted in this third memory region for each physical target location 30, 40, which signal an availability for a new determination by showing, in particular, that the physical target location 30, 40 is empty. This is made possible through a suitable monitoring of physical target locations 30, 40.

A visual display, not shown in the drawing, is arranged at each of physical target locations 30, 40. The visual display is actuated by the control device such that it continuously displays information showing the logical target location assigned to the physical target location 30, 40. For a sorting according to delivery regions, this can be a plain text display of the delivery region, for example. The first memory region for the device assigning the logical target locations can be reprogrammed by means of a device provided in the control device, which makes it possible, for example, to replace the sorting table stored therein with a new sorting table. It is also possible to store more than one sorting table in the first memory region and to switch the sorting operation from one sorting table to another sorting table by issuing a switching command. This means that following the switching command, the total number of articles 26 to be sorted to which the logical target locations have been assigned under the sorting table valid before the switching command was issued declines rapidly, in that these articles to be sorted are delivered by receiving elements 12 to the respective physical target locations 30, 40, while only those articles 26 to be sorted are delivered anew to the empty receiving elements 12, to which the logical target locations must be assigned on the basis of the sorting table valid after the switching command was issued. The control device correspondingly reduces physical target locations 30, 40 determined for the logical target locations valid prior to the switching command and assigns these freed physical target locations 30, 40 gradually to the logical target locations that are assigned according to the currently valid sorting table. It is possible in this way to switch from one sorting table to another sorting table with a negligible reduction in performance.

The invention has been described in detail with respect to preferred embodiments, and it will now be apparent to those skilled in the art from the foregoing that changes and modifications may be made without departing from the invention its broader aspects, and the invention, therefore, as defined in the appended claims, is intended to cover all such changes and modification as fall within the true spirit of the invention.

What is claimed is:

1. A method for controlling an arrangement to distribute articles to be sorted to physical target locations, comprising:

feeding articles to be sorted to respective ones of a plurality of receiving elements, each article containing an information set having a reference content corresponding to one address;

transporting the articles to be sorted in the receiving elements along a conveying path past physical target locations;

detecting the respective information sets provided on the individual articles to be sorted;

assigning a logical target location to each article to be sorted in a predetermined dependence on the detected information set;

determining flow rate values during an operating sequence for the articles assigned to the logical target locations;

determining the physical target location to which each article assigned a logical target location is to be delivered in dependence on the flow-rate values;

delivering and selectively releasing the articles from the receiving elements to a respective one of the determined physical target locations.

2. The method according to claim 1, wherein the step of determining flow rate values includes determining, during a unit of time, a sum of thicknesses measured along a predetermined direction in space of the articles to be sorted which are assigned to a respective one of the logical target locations.

3. The method according to claim 2, wherein the step of determining a sum of thickness includes measuring the thicknesses of the respective articles to be sorted prior to the feeding step.

4. The method according to claim 1, wherein the step of detecting the information sets occurs prior to the feeding step.

5. The method according to claim 1, wherein the step of determining the physical target location includes determining more than one physical target location for a logical target location having a high flow-rate as compared to other logical target locations.

6. The method according to any one of claims 1 to 5, further including keeping the articles to be sorted, which are assigned to a logical target location having a low flow rate as compared to other logical target locations, inside their receiving elements for the duration of a dwell time and delaying the step of determining the physical target location for the logical target location having the low flow rate during the dwell time.

7. The method according claim 1, including changing the assignment of the logical target locations determined by the preset dependence during the operating sequence and determining physical target locations, selected from a number of physical target locations determined under the previously preset dependence, for the logical target locations assigned under the new preset dependence on the basis of the detected information sets.

8. A control device for an arrangement designed to distribute articles to be sorted to physical target locations comprising:

a plurality of receiving elements;

a feeder for feeding articles to be sorted to respective ones of the plurality of receiving elements, each article containing an information set having a reference content corresponding to one address;

a plurality of physical target locations;

means for conveying the receiving elements along a conveying path past the physical target locations;

the receiving elements each including a first device that can be activated to release the article to be sorted from the receiving element to a selected physical target location while the receiving element is transported past the physical location;

a second device for detecting the information sets on the articles to be sorted;

a control device for activating the first device in dependence on the detected information sets for a selective release of the articles to be sorted to the physical target locations, the control device comprising:

a third device for assigning logical target locations to the articles to be sorted in accordance with a predetermined dependence on the detected information sets;

a fourth device for determining flow rate values for the articles to be sorted which are assigned to the logical target locations; and a fifth device for determining the physical target locations to which the articles to be sorted are delivered in dependence on the determined flow-rate values.

9. The arrangement according to claim 8, wherein the third device includes a first memory region where the preset dependence of the logical target locations on the detected information sets is stored and from which the respectively assigned logical target location is read out for each detected information set, and a second memory region which stores for each receiving element the logical target location assigned to the article to be sorted and delivered to the receiving element.

10. The arrangement according to claim 8, wherein the fifth device includes a third memory region for storing the assignment between the logical target locations and the physical target locations.

11. The arrangement according to claim 8, wherein the fourth device includes: means for measuring a thickness of the individual articles to be sorted along a predetermined direction in space, and a sixth device for summing up the thicknesses measured over a specific unit of time of the articles to be sorted which are assigned to each logical target location.

12. The arrangement according to claim 8, wherein the third device is responsive to an external switching command for making an assignment according to another preset dependence, and the fifth device selects physical target locations from a number of physical target locations that were determined based on the dependence predetermined before the switching command was issued.

13. The arrangement according to claim 12, wherein the control device includes a unit for reprogramming the first memory region of the third device.

14. The arrangement according to claim 8, and further comprising a visual display associated with each physical target location and which is actuated by the control device for displaying information showing the respectively corresponding logical target location.

* * * * *